US006786485B2

(12) United States Patent
Frieman

(10) Patent No.: US 6,786,485 B2
(45) Date of Patent: Sep. 7, 2004

(54) DICE GAME APPARATUS AND METHODS FOR USING SAME

(76) Inventor: Shlomo Ruvane Frieman, 139 S. Mansfield Ave., Los Angeles, CA (US) 90036

( * ) Notice: Subject to any disclaimer, the term of this patent is extended or adjusted under 35 U.S.C. 154(b) by 0 days.

(21) Appl. No.: 10/231,831

(22) Filed: Aug. 30, 2002

(65) Prior Publication Data

US 2004/0041342 A1 Mar. 4, 2004

(51) Int. Cl.[7] ..... A63F 9/04
(52) U.S. Cl. ..... 273/146; D21/372
(58) Field of Search ..... 273/146; D21/372, D21/373

(56) References Cited

U.S. PATENT DOCUMENTS

| | | | | | |
|---|---|---|---|---|---|
| 1,523,615 | A | | 1/1925 | Stern | |
| 2,077,010 | A | | 4/1937 | Robertson | |
| 3,208,754 | A | | 9/1965 | Sieye | |
| 3,959,893 | A | | 6/1976 | Sigg | |
| 4,114,290 | A | * | 9/1978 | Cooper | 273/145 CA |
| 4,239,226 | A | * | 12/1980 | Palmer | 273/146 |
| 4,452,588 | A | | 6/1984 | Smith | |
| 4,717,154 | A | * | 1/1988 | Miller | 273/243 |
| 5,511,782 | A | * | 4/1996 | Maley | 273/146 |
| 5,707,239 | A | | 1/1998 | Butler | |
| 6,065,749 | A | * | 5/2000 | Debie | 273/243 |
| 6,089,871 | A | * | 7/2000 | Jaffe | 434/209 |

FOREIGN PATENT DOCUMENTS

| | | | |
|---|---|---|---|
| FR | 2451761 | * 11/1980 | 273/146 |
| WO | WO98/46320 | * 10/1998 | |

* cited by examiner

*Primary Examiner*—Benjamin H. Layno

(57) ABSTRACT

A dice game apparatus comprises a first numerical die, a second numerical die, and at least one operator die selected from the group consisting of a first operator die and a second operator die. While the dice game apparatus comprises the first operator die and/or the second operator die, the dice games are played with just three dice, namely, the first numerical die, the second numerical die, and either the first operator die or the second operator die.

18 Claims, 4 Drawing Sheets

1,300

1,400

1,500

1,600

DICE GAME APPARATUS AND METHODS FOR USING SAME

FIELD OF THE INVENTION

The present invention relates to an educational dice game apparatus for use by one or more young players who are learning basic mathematical skills such as addition, subtraction, and multiplication. The dice game apparatus enables the participants to engage in various dice games which are educational and entertaining and which increase their ability to quickly and easily solve mathematical problems such as addition, subtraction, and multiplication.

DESCRIPTION OF THE PRIOR ART

A comprehensive description of the prior art is set forth in U.S. Pat. No. 1,523,615, U.S. Pat. No. 2,077,010, U.S. Pat. No. 3,208,754, U.S. Pat. No. 3,959,893, U.S. Pat. No. 4,452,588, and U.S. Pat. No. 5,707,239, which patents are incorporated herein in their entireties by reference.

Several educational dice games exist. See, for example, U.S. Pat. No. 3,959,893, U.S. Pat. No. 4,452,588, and U.S. Pat. No. 5,707,239. However, no dice game apparatus has been to teach young children the very basic mathematical skills of adding, subtracting, and multiplying using just three dice.

SUMMARY OF THE INVENTION

Accordingly, there is a need for a dice game, for use by young children who are learning very basic mathematical skills such as adding, subtracting, and multiplying the numbers 0 through 6, 8, 10, 12, or higher, which uses just three dice.

The present invention solves the need set forth in the preceding paragraph by providing a dice game apparatus comprising a first numerical die, a second numerical die, and at least one operator die selected from the group consisting of a first operator die and a second operator die. While the dice game apparatus comprises the first operator die and/or the second operator die, dice games within the scope of the present invention are played with just three dice, namely, the first numerical die, the second numerical die, and either the first operator die or the second operator die.

More specifically, the dice game apparatus of the present invention comprises at least one set of dice. Each set of dice consists essentially of (a) a first numerical die, (b) a second numerical die, and (c) at least one operator die selected from the group consisting of a first operator die and a second operator die. The first numerical die has (i) at least $N_1$ faces, with $N_1$ being a whole, even number from 6 to 20, and (ii) $N_1/2$ pairs of opposing, spaced apart faces, with each of the $N_1/2$ pairs of opposing, spaced apart faces of the first numerical die lying in a pair of substantially parallel planes. Each face of the first numerical die bears a different first indicia of numerical value from 0 to $N_1$, provided that if 0 appears on any face of the first numerical die, the highest first indicia of numerical value on any face of the first numerical die is $N_1/1$.

Like the first numerical die, the second numerical die has (i) at least $N_2$ faces, with $N_2$ being a whole, even number from 6 to 20, and $N_2/2$ pairs of opposing, spaced apart faces, with each of the $N_2/2$ pairs of opposing, spaced apart faces of the second numerical die lying in a pair of substantially parallel planes. Each face of the second numerical die bears a different second indicia of numerical value from 0 to $N_2$, provided that if 0 appears on any face of the second numerical die, the highest second indicia of numerical value on any face of the second numerical die is $N_2-1$.

Regarding the first operator die, the first operator die has (i) at least $N_3$ faces, with $N_3$ being a whole, even number from 6 to 20, and (ii) $N_3/2$ pairs of opposing, spaced apart faces, with each of the $N_3/2$ pairs of opposing, spaced apart faces of the first operator die lying in a pair of substantially parallel planes. The first operator die bears (A) a third indicia representing the mathematical operation of addition on $X_1$ of the faces of the first operator die, where $X_1$ is a whole number from 1 to $2/3N_3$, (B) a fourth indicia representing the mathematical operation of subtraction on $Y_1$ of the faces of the first operator die, where $Y_1$ is a whole number from 1 to $2/3N_3$, and (C) a fifth indicia representing a mathematical operation to be chosen by a player, the mathematical operation being selected from the group consisting of addition, subtraction, multiplication, and division on $Z_1$ of the faces of the first operator die, where $Z_1$ is a whole number from 0 to $1/3N_3$, with the sum of $X_1$, $Y_1$, $Z_1$ equaling $N_3$.

Similar to the first operator die, the second operator die has (i) at least $N_4$ faces, with $N_4$ being a whole, even number from 6 to 20, and (ii) $N_4/2$ pairs of opposing, spaced apart faces, with each of the $N_4/2$ pairs of opposing, spaced apart faces of the second operator die lying in a pair of substantially parallel planes. However, the second operator die bears (A) a sixth indicia representing the mathematical operation of addition on $X_2$ of the faces of the second operator die, where $X_2$ is a whole number from 1 to $1/2N_4$, (B) a seventh indicia representing the mathematical operation of subtraction on $Y_2$ of the faces of the second operator die, where $Y_2$ is a whole number from 1 to $1/2N_4$, (C) an eighth indicia representing the mathematical operation of multiplication on $Z_2$ of the faces of the second operator die, where $Z_2$ is a whole number from 1 to $1/2N_4$, and (D) a ninth indicia representing a mathematical operation to be chosen by a player, the mathematical operation being selected from the group consisting of addition, subtraction, multiplication, and division on $A_2$ of the faces of the second operator die, where $A_2$ is a whole number from 0 to $1/4N_4$, with the sum of $X_2$, $Y_2$, $Z_2$, and $A_2$ equaling $N_4$.

Preferably, each of the faces of the first numerical die has substantially the same surface area, each of the faces of the second numerical die has substantially the same surface area, each of the faces of the first operator die has substantially the same surface area, and each of the faces of the second operator die has substantially the same surface area. More preferably, each of the faces of the first numerical die, each of the faces of the second numerical die, each of the faces of the first operator die, and each of the faces of the second operator die has substantially the same surface area.

Desirably, the dice game apparatus of the present invention comprises the first operator die and the second operator die. Also, the first numerical die, the second numerical die, the first operator die, and the second operator die preferably have the same number of faces, i.e., $N_1$, $N_2$, $N_3$, and $N_4$ are preferably equal.

In one embodiment of the present invention, the dice game apparatus comprises a set of dice consisting essentially of (1) a hexahedron first numerical die bearing a different first indicia of numerical value from 0 to 6 on each of its six faces, provided that if 0 appears on any face of the first numerical die, the highest indicia of numerical value on any face of the first numerical die is 5, (2) a hexahedron second numerical die bearing a different second indicia of numerical value from 0 to 6 on each of its six faces, provided that if 0 appears on any face of the second numerical die, the highest indicia of numerical value on any face of the second numeric die is 5, (3) a hexahedron first operator die bearing (a) a third indicia representing the mathematical operation of addition on $X_1$ of the faces of the first operator die, where $X_1$ is a whole number from 1 to 4, (b) a fourth indicia representing the mathematical operation of subtraction on $Y_1$ of the faces of the first operator die, where $Y_1$ is a whole number from 1 to 4, and (c) a fifth indicia representing a mathematical operation of choice on $Z_1$ of the faces of the first operator die, where $Z_1$ is a whole number from 0 to 2 (with the sum of $X_1$, $Y_1$, and $Z_1$ equaling 6), and (4) a hexahedron the second operator die bearing (a) a sixth indicia representing the mathematical operation of addition on $X_2$ of the faces of the second operator die, where $X_2$ is a whole number from 1 to 3, (b) a seventh indicia representing the mathematical operation of subtraction on $Y_2$ Of the faces of the second operator die, where $Y_2$ is a whole number from 1 to 3, (c) an eighth indicia representing the mathematical operation of multiplication on $Z_2$ of the faces of the second operator die, where $Z_2$ is a whole number from 1 to 3, and (d) a ninth indicia representing a mathematical operation of choice on $A_2$ of the faces of the second operator die, where $A_2$ is a whole number from 0 to 2 (with the sum of $X_2$, $Y_2$, $Z_2$, and $A_2$ equaling 6). (As used in the specification and claims, the term "indicia of numerical value" means a visible representation of a number in the form of a pictorial image (e.g., visible depressions or indentations, elevations, geometrical shapes, animal shapes, blank spaces, any other visible markings, and combinations thereof) and/or in the form of a symbolic image (e.g., Arabic numerals 0, 1, 2, 3, 4, 5, 6, 7, 8, 9, 10, etc., Roman numerals I, II, III, IV, V, VI, VII, VIII, IX, X, etc., Greek numbers, Chinese numbers, Korean numbers, Egyptian numbers, and any other symbolic numerical script) displayed on the faces of the numerical dice; the term "indicia of addition" means any symbol (e.g.,"+") displayed on a face of the operator die to denote the mathematical operation of addition; the term "indicia of subtraction" means any symbol (e.g., "−") displayed on a face of the operator die to denote the mathematical operation of subtraction; the term "indicia of multiplication" means any symbol (e.g., "×" and "·") displayed on a face of the operator die to denote the mathematical operation of multiplication; and the term "mathematical operation of choice" means a mathematical that is chosen by a player, the mathematical operation being selected from the group consisting of addition, subtraction, multiplication, and division.) Preferably, (a) each face of the first numerical die bears a different first indicia of numerical value from 0 to 5, (b) each face of the second numerical die bears a different second indicia of numerical value from 0 to 5, (c) the first operator die bears (i) a third indicia representing the mathematical operation of addition on 2 of its faces, (ii) a fourth indicia representing the mathematical operation of subtraction on 2 of its faces, and (iii) a fifth indicia representing a mathematical operation of choice on 2 of its faces, and (d) the second operator die bears (i) a sixth indicia representing the mathematical operation of addition on 2 of its faces, (ii) a seventh indicia representing the mathematical operation of subtraction on 2 of its faces, (iii) an eighth indicia representing the mathematical operation of multiplication on 2 of its faces.

In another embodiment of the present invention, the dice game apparatus comprises a set of dice consisting essentially of (1) an octahedron first numerical die bearing a different first indicia of numerical value from 0 to 8 on each of its eight faces, provided that if 0 appears on any face of the first numerical die, the highest indicia of numerical value on any face of the first numerical die is 7, (2) an octahedron second numerical die bearing a different second indicia of numerical value from 0 to 8 on each of its eight faces, provided that if 0 appears on any face of the second numerical die, the highest indicia of numerical value on any face of the second numeric die is 7, (3) an octahedron first operator die bearing (a) a third indicia representing the mathematical operation of addition on $X_1$ of the faces of the first operator die, where $X_1$ is a whole number from 1 to 5, (b) a fourth indicia representing the mathematical operation of subtraction on $Y_1$ of the faces of the first operator die, where $Y_1$ is a whole number from 1 to 5, and (c) a fifth indicia representing a mathematical operation of choice on $Z_1$ of the faces of the first operator die, where $Z_1$ is a whole number from 0 to 2 (with the sum of $X_1$, $Y_1$, and $Z_1$ equaling 8), and (4) an octahedron the second operator die bearing (a) a sixth indicia representing the mathematical operation of addition on $X_2$ of the faces of the second operator die, where $X_2$ is a whole number from 1 to 4, (b) a seventh indicia representing the mathematical operation of subtraction on $Y_2$ of the faces of the second operator die, where $Y_2$ is a whole number from 1 to 4, (c) an eighth indicia representing the mathematical operation of multiplication on $Z_2$ of the faces of the second operator die, where $Z_2$ is a whole number from 1 to 4, and (d) a ninth indicia representing a mathematical operation of choice on $A_2$ of the faces of the second operator die, where $A_2$ is a whole number from 0 to 2(with the sum of $X_2$, $Y_2$, $Z_2$, and $A_2$ equaling 8). Preferably, each of the faces of the first numerical, second numerical, first operator, and second operator dice are substantially circular and have the same surface area. It is also preferred that (a) each face of the first numerical die bears a different first indicia of numerical value from 1 to 8, (b) each face of the second numerical die bears a different second indicia of numerical value from 1 to 8, (c) the first operator die bears (i) a third indicia representing the mathematical operation of addition on 3 of its faces, (ii) a fourth indicia representing the mathematical operation of subtraction on 3 of its faces, and (iii) a fifth indicia representing a mathematical operation of choice on 2 of its faces, and (d) the second operator die bears (i) a sixth indicia representing the mathematical operation of addition on 2 of its faces, (ii) a seventh indicia representing the mathematical operation of subtraction on 2 of its faces, (iii) an eighth indicia representing the mathematical operation of multiplication on 2 of its faces, and (iv) a ninth indicia representing a mathematical operation of choice on 2 of its faces.

In a third embodiment of the invention, the dice game apparatus comprises a set of dice consisting essentially of (1) a decahedron first numerical die bearing a different first indicia of numerical value from 0 to 10 on each of its ten faces, provided that if 0 appears on any face of the first numerical die, the highest indicia of numerical value on any face of the first numerical die is 9, (2) a decahedron second numerical die bearing a different second indicia of numerical value from 0 to 10 on each of its ten faces, provided that if 0 appears on any face of the second numerical die, the highest indicia of numerical value on any face of the second numeric die is 9, (3) a decahedron first operator die bearing (a) a third indicia representing the mathematical operation of addition on $X_1$ of the faces of the first operator die, where $X_1$ is a whole number from 1 to 6, (b) a fourth indicia representing the mathematical operation of subtraction on $Y_1$ of the faces of the first operator die, where $Y_1$ is a whole number from 1 to 6, and (c) a fifth indicia representing a mathematical operation of choice on $Z_1$ of the faces of the first operator die, where $Z_1$ is a whole number from 0 to 3 (with the sum of $X_1$, $Y_1$, and $Z_1$ equaling 10), and (4) a decahedron second operator die bearing (a) a sixth indicia representing the mathematical operation of addition on $X_2$ of the faces of the second operator die, where $X_2$ is a whole number from 1 to 5, (b) a seventh indicia representing the mathematical operation of subtraction on $Y_2$ of the faces of the second operator die, where $Y_2$ is a whole number from 1 to 5, (c) an eighth indicia representing the mathematical operation of multiplication on $Z_2$ of the faces of the second operator die, where $Z_2$ is a whole number from 1 to 5, and (d) a ninth indicia representing a mathematical operation of choice on $A_2$ of the faces of the second operator die, where $A_2$ is a whole number from 0 to 2 (with the sum of $X_2$, $Y_2$, $Z_2$, and $A_2$ equaling 10). Preferably, each of the faces of the first numerical, second numerical, first operator, and second operator dice are substantially circular and have the same surface area. It is also preferred that (a) each face of the first numerical die bears a different first indicia of numerical value from 1 to 10, (b) each face of the second numerical die bears a different second indicia of numerical value from 1 to 10, (c) the first operator die bears (i) a third indicia representing the mathematical operation of addition on 4 of its faces, (ii) a fourth indicia representing the mathematical operation of subtraction on 4 of its faces, and (iii) a fifth indicia representing a mathematical operation of choice on 2 of its faces, and (d) the second operator die bears (i) a sixth indicia representing the mathematical operation of addition on 3 of its faces, (ii) a seventh indicia representing the mathematical operation of subtraction on 3 of its faces, (iii) an eighth indicia representing the mathematical operation of multiplication on 3 of its faces, and (iv) a ninth indicia representing a mathematical operation of choice on 1 of its faces.

In a fourth embodiment of the invention, the dice game apparatus comprises a set of dice consisting essentially of (1) a dodecahedron first numerical die bearing a different first indicia of numerical value from 0 to 12 on each of its twelve faces, provided that if 0 appears on any face of the first numerical die, the highest indicia of numerical value on any face of the first numerical die is 11, (2) a dodecahedron second numerical die bearing a different second indicia of numerical value from 0 to 12 on each of its twelve faces, provided that if 0 appears on any face of the second numerical die, the highest indicia of numerical value on any face of the second numeric die is 11, (3) a dodecahedron first operator die bearing (a) a third indicia representing the mathematical operation of addition on $X_1$ of the faces of the first operator die, where $X_1$ is a whole number from 1 to 8, (b) a fourth indicia representing the mathematical operation of subtraction on $Y_1$ of the faces of the first operator die, where $Y_1$ is a whole number from 1 to 8, and (c) a fifth indicia representing a mathematical operation of choice on $Z_1$ of the faces of the first operator die, where $Z_1$ is a whole number from 0 to 4 (with the sum of $X_1$, $Y_1$, and $Z_1$ equaling 12), and (4) a dodecahedron second operator die bearing (a) a sixth indicia representing the mathematical operation of addition on $X_2$ of the faces of the second operator die, where $X_2$ is a whole number from 1 to 6, (b) a seventh indicia representing the mathematical operation of subtraction on $Y_2$ of the faces of the second operator die, where $Y_2$ is a whole number from 1 to 6, (c) an eighth indicia representing the mathematical operation of multiplication on $Z_2$ of the faces of the second operator die, where $Z_2$ is a whole number from 1 to 6, and (d) a ninth indicia representing a mathematical operation of choice on $A_2$ of the faces of the second operator die, where $A_2$ is a whole number from 0 to 3 (with the sum of $X_2$, $Y_2$, $Z_2$, and $A_2$ equaling 12). It is also preferred that (a) each face of the first numerical die bears a different first indicia of numerical value from 1 to 12, (b) each face of the second numerical die bears a different second indicia of numerical value from 1 to 12, (c) the first operator die bears (i) a third indicia representing the mathematical operation of addition on 4 of its faces, (ii) a fourth indicia representing the mathematical operation of subtraction on 4 of its faces, and (iii) a fifth indicia representing a mathematical operation of choice on 4 of its faces, and (d) the second operator die bears (i) a sixth indicia representing the mathematical operation of addition on 3 of its faces, (ii) a seventh indicia representing the mathematical operation of subtraction on 3 of its faces, (iii) an eighth indicia representing the mathematical operation of multiplication on 3 of its faces, and (iv) a ninth indicia representing a mathematical operation of choice on 3 of its faces.

While the dice game apparatus comprises one or more of the above described sets of dice, dice games within the scope of the present invention only use two numerical dice and one operator die. Accordingly, the dice game apparatus of the present invention and dice games within the scope of the invention have many desirable features. For example, young children can play the game of dice alone or with one or more other players. In addition, since only three dice are required to play the dice games of the present invention, the dice game apparatus is very portable and compact. In addition, although no game board is need to play the dice games of the present invention, any game board can be used with the number of places a player advances being determined, for instance, by the value of a correct answer (e.g., a correct answer from adding the two numerical dice enabling the player to advance one place, a correct answer from subtracting the two numerical dice enabling the player to advance two places, a correct answer from multiplying the two numerical dice enabling the player to advance three places, and a correct answer from dividing the two numerical dice enabling the player to advance four places). Furthermore, the dice games of the present invention are very fast paced, thereby holding the youngsters' attention while helping them to sharper their addition, subtraction, multiplication, and division skills.

For a fuller understanding of the nature and advantages of the dice game apparatus of the present invention, reference should be made to the ensuing detailed description taken in conjunction with the accompanying drawings.

BRIEF DESCRIPTION OF THE DRAWINGS

Exemplary dice game apparatuses employed in the dice games of the present invention are shown in the drawings where.

DETAILED DESCRIPTION OF THE INVENTION

As summarized in the following Table I, the dice game apparatus of the present invention comprises at least one set of dice, where each set of dice consists essentially of (a) a first numerical die, (b) a second numerical die, and (c) at least one operator die selected from the group consisting of a first operator die and a second operator die.

TABLE I

Figure 1:
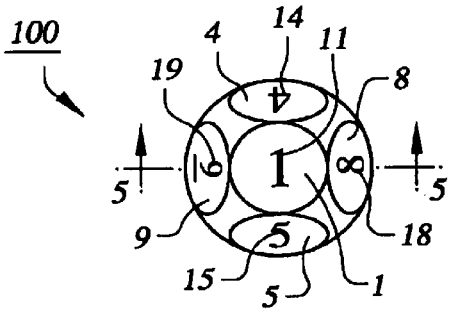
FIG. 1 is a top view of a decahedron first numerical die, where each of the ten faces of the die is substantially circular and has substantially the same surface area.
Figure 2:
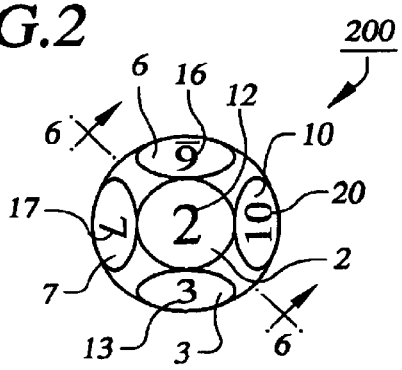
FIG. 2 is a bottom view of a decahedron second numerical die, where each of the ten faces of the die is substantially circular and has substantially the same surface area.
Figure 6:
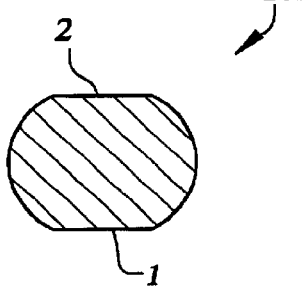
FIG. 6 is a cross-sectional view of the decahedron second numerical die of FIG. 2 taken along line 6—6.
Figure 3:
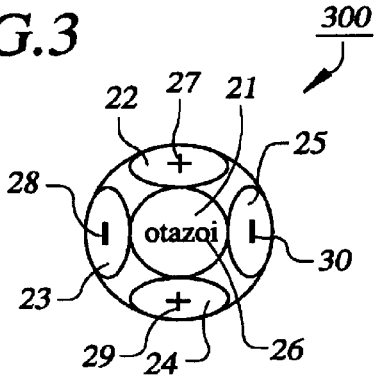
FIG. 3 is a top view of a decahedron first operator die, where each of the ten faces of the die is substantially circular and has substantially the same surface area.
Figure 7:
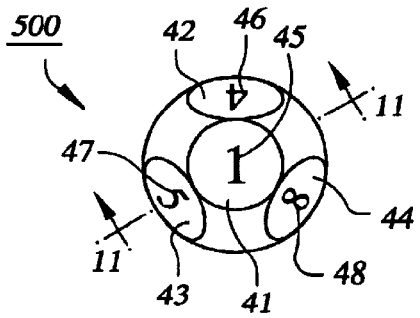
FIG. 7 is a top view of an octahedron first numerical die, where each of the eight faces of the die is substantially circular and has substantially the same surface area.
Figure 8:
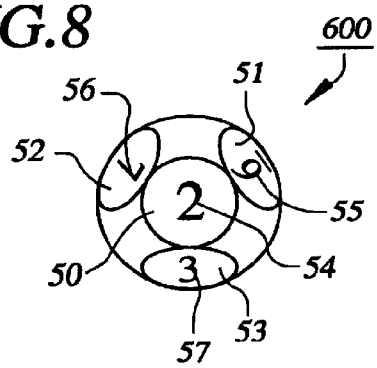
FIG. 8 is a bottom view of an octahedron second numerical die, where each of the eight faces of the die is substantially circular and has substantially the same surface area.
Figure 9:
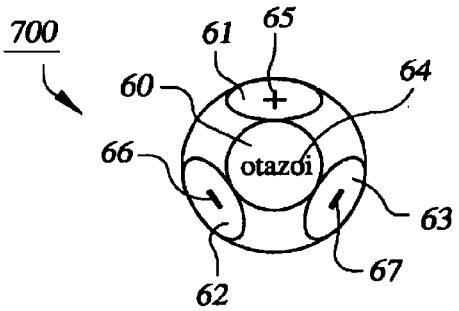
FIG. 9 is a top view of an octahedron first operator die, where each of the eight faces of the die is substantially circular and has substantially the same surface area.
Figure 12:
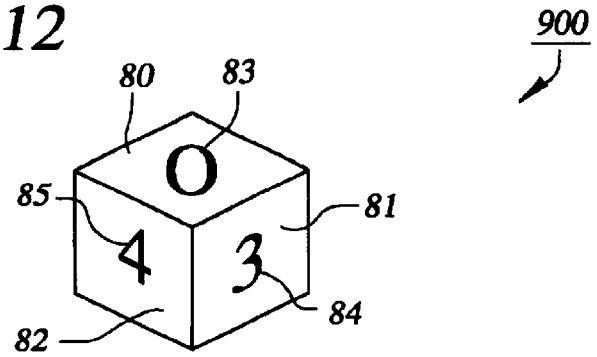
FIG. 12 is a top perspective of a hexahedron first numerical die, where each of the six faces of the die has substantially the same surface area.
Figure 13:
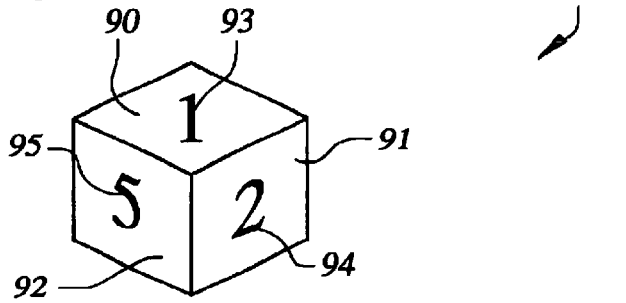
FIG. 13 is a bottom perspective view of a hexahedron second numerical die, where each of the six faces of the die has substantially the same surface area.
Figure 14:
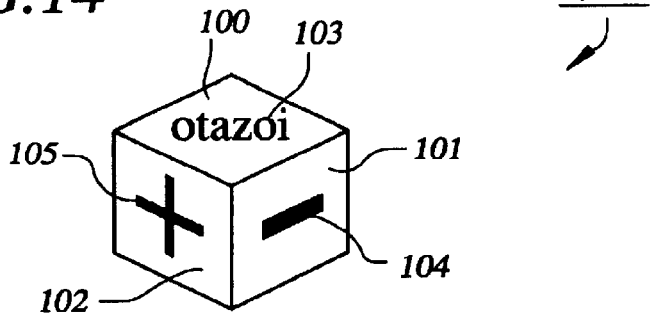
FIG. 14 is a top perspective view of a hexahedron first operator die, where each of the six faces of the die has substantially the same surface area.
Figure 16:
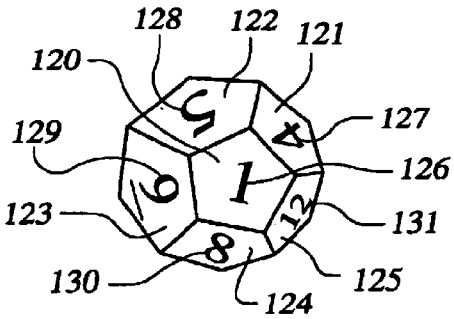
FIG. 16 is a top perspective view of a dodecahedron first numerical die, where each of the twelve faces of the die is substantially pentagonal and has substantially the same surface area.
Figure 17:
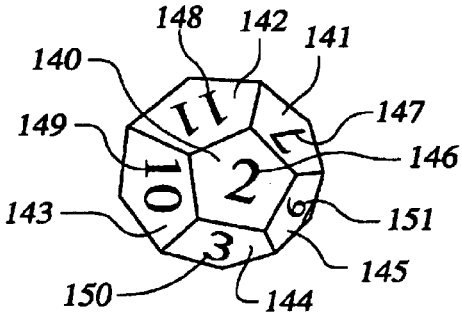
FIG. 17 is a bottom perspective view of a dodecahedron second numerical die, where each of the twelve faces of the die is substantially pentagonal and has substantially the same surface area.
Figure 18:
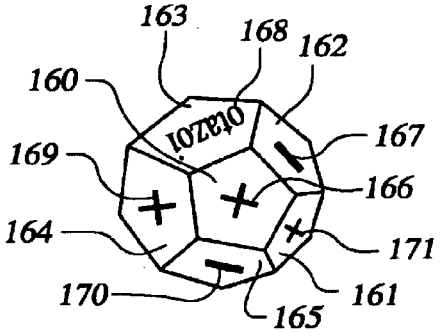
FIG. 18 is a top perspective view of a dodecahedron first operator die, where each of the twelve faces of the die is substantially pentagonal and has substantially the same surface area.

| Dice Sets | | | |
|---|---|---|---|
| Set | First Numerical Die of | Second Numerical Die of | Operator Die of |
| 1 | FIG. 1 | FIG. 2 | FIG. 3 and/or 4 |
| 2 | FIG. 7 | FIG. 8 | FIG. 9 and/or 10 |
| 3 | FIG. 12 | FIG. 13 | FIG. 14 and/or 15 |
| 4 | FIG. 16 | FIG. 17 | FIG. 18 and/or 19 |

While the dice game apparatus comprises one or more sets of dice, with each set of dice consists essentially of (and preferably, consisting of) two numerical dice and one or two operator dice, the dice games of the present invention are played with only three dice, namely, two numerical dice and one operator die.

Sets of dice consisting of decahedron, octahedron, hexahedron, and dodecahedron dice are described in more detail below.

Set of Decahedron Dice

With respect to FIGS. 1 and 2, a decahedron first numerical die 100 of FIG. 1 is substantially identical to a decahedron second numerical die 200 of FIG. 2. Each of the decahedron first and second numerical dice has ten faces, including faces 1, 4, 5, 8, and 9 as show in FIG. 1 and faces 2, 3, 6, 7, and 10 as shown in FIG. 2. Each of faces 1 through 10 of the decahedron first and second numerical dice 100 and 200, respectively, is substantially circular, has substantially the same diameter (see FIG. 5), has substantially the same surface area, and bears a different indicia of numerical value (e.g., the Arabic numerals 1, 4, 5, 8, and 9 as shown in FIG. 1 as respective items 11, 14, 15, 18, and 19 and the Arabic numerals 2, 3, 6, 7, and 10 as shown in FIG. 2 as respective items 12, 13, 16, 17, and 20). In addition, each of faces 1 through 10 of decahedron first and second numerical dice 100 and 200, respectively, has an. opposing face that lies in a substantially parallel plane. (In other words, each of the decahedron first and second numerical dice 100 and 200, respectively, has 5 pairs of opposing faces that lie in substantially parallel planes.) For example, the pairs of substantially parallel opposing planes shown in FIGS. 5 and/or 6 are summarized in the following Table II:

TABLE II

Figure 5:
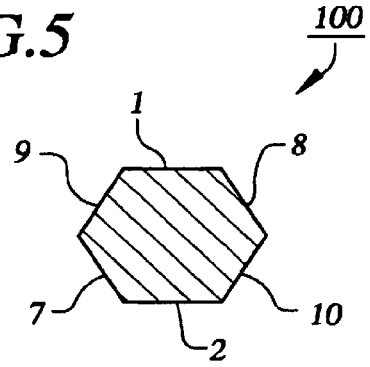
FIG. 5 is a cross-sectional view of the decahedron first numerical die of FIG. 1 taken along line 5—5.

| Opposing, Substantially Parallel Pairs of Faces Shown in FIGS. 5 and/or 6 |
|---|
| Faces 1 and 2 |
| Faces 7 and 8 |
| Faces 9 and 10 |

A decahedron first operator die 300 shown in FIG. 3 is identical in shape to the decahedron first and second numerical dice 100 and 200 illustrated in FIGS. 1 and 2, respectively. However, each of the ten faces (including faces 21 through 25 shown in FIG. 3) of the decahedron first operator die 300 bears an indicia representing a mathematical operation (such as addition, subtraction, or a mathematical operation to be chosen by a player) as opposed to the indicia of numerical value born by the faces 1 through 10 of the decahedron first and second numerical dice 100 and 200, respectively. More specifically, as shown in FIG. 3, faces 22 and 24 bear "+" signs 27 and 29, respectively, representing the mathematical operation of addition, faces 23 and 25 bear "–" signs 28 and 30, respectively, representing the mathematical operation of subtraction, and face 21 bears the word "otazoi" 26 representing a mathematical operation of choice.

Figure 4:
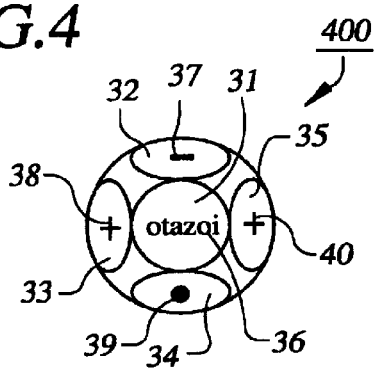
FIG. 4 is a top view of a decahedron second operator die, where each of the ten faces of the die is substantially circular and has substantially the same surface area.

FIG. 4 illustrates a decahedron second operator die 400 that is also identical in shape to the decahedron first and second numerical dice 100 and 200 illustrated in FIGS. 1 and 2, respectively. However, similar to the first operator die 300 of FIG. 3, each of the ten faces (including faces 31 through 35 shown in FIG. 4) of the decahedron second operator die 400 bears an indicia representing a mathematical operation (such as addition, subtraction, multiplication, or a mathematical operation to be chosen by a player) as opposed to the indicia of numerical value born by the faces 1 through 10 of the decahedron first and second numerical dice 100 and 200, respectively. More specifically, as shown in FIG. 4, faces 33 and 35 bear "+" signs 38 and 40, respectively, representing the mathematical operation of addition, face 32 bears a "−" sign 37 representing the mathematical operation of subtraction, face 34 bears a "·" sign 39 representing the mathematical operation of multiplication, and face 31 bears the word "otazoi" 36 representing a mathematical operation of choice.

Set of Octahedron Dice

With respect to FIGS. 7 and 8, an octahedron first numerical die 500 of FIG. 7 is substantially identical to an octahedron second numerical die 600 of FIG. 8. Each of the octahedron first and second numerical dice 500 and 600, respectively, has eight faces, including faces 41, 42, 43, and 44 as show in FIG. 7 and faces 50, 51, 52, and 53 as shown in FIG. 8. Each of faces 41 through 44 and 50 through 53 of the octahedron first and second numerical dice 500 and 600, respectively, is substantially circular, has substantially the same diameter (see FIG. 11), has substantially the same surface area, and bears a different indicia of numerical value (e.g., the Arabic numerals 1, 4, 5, and 8 as shown in FIG. 7 as respective items 45 through 48 and the Arabic numerals 2, 3, 6, and 7 as shown in FIG. 8 as respective items 54 through 57). In addition, each of faces 41 through 44 and 50 through 53 of octahedron first and second numerical dice 500 and 600, respectively, has an opposing face that lies in a substantially parallel plane. (In other words, each of the octahedron first and second numerical dice 500 and 600, respectively, has 4 pairs of opposing faces that lie in substantially parallel planes.) For example, the pairs of substantially parallel opposing planes shown in FIG. 11 are summarized in the following Table III:

TABLE III

Figure 11:
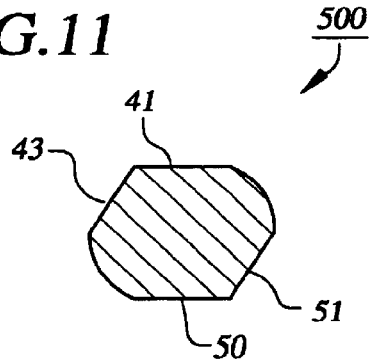
FIG. 11 is a cross-sectional view of the octahedron first numerical die of FIG. 7 taken along line 11—11.

| Opposing, Substantially Parallel Pairs of Faces Shown in FIG. 11 |
|---|
| Faces 41 and 50 |
| Faces 43 and 51 |

An octahedron first operator die 700 shown in FIG. 9 is identical in shape to the octahedron first and second numerical dice 500 and 600 illustrated in FIGS. 7 and 8, respectively. However, each of the eight faces (including faces 60 through 63 shown in FIG. 9) of the octahedron first operator die bears an indicia representing a mathematical operation (such as addition, subtraction, or a mathematical operation to be chosen by a player) as opposed to the indicia of numerical value born by the faces 41 through 44 and 50 through 53 of the octahedron first and second numerical dice 500 and 600, respectively. More specifically, as shown in FIG. 9, face 61 bears a "+" sign 65 representing the mathematical operation of addition, faces 62 and 63 bear "−" signs 66 and 67, respectively, representing the mathematical operation of subtraction, and face 60 bears the word "otazoi" 64 representing a mathematical operation of choice.

Figure 10:
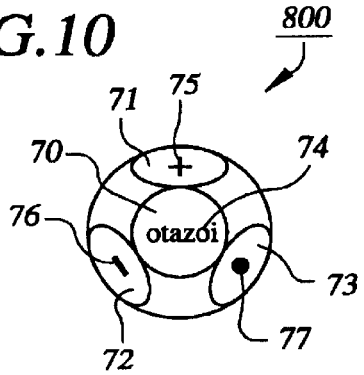
FIG. 10 is a top view of an octahedron second operator die, where each of the eight faces of the die is substantially circular and has substantially the same surface area.

FIG. 10 illustrates an octahedron second operator die 800 that is also identical in shape to the octahedron first and second numerical dice 500 and 600 illustrated in FIGS. 7 and 8, respectively. However, similar to the first operator die 700 of FIG. 9, each of the eight faces (including faces 70 through 73 shown in FIG. 10) of the octahedron second operator die 800 bears an indicia representing a mathematical operation (such as addition, subtraction, multiplication, or a mathematical operation to be chosen by a player) as opposed to the indicia of numerical value born by the faces 41 through 44 and 50 through 53 of the octahedron first and second numerical dice 500 and 600, respectively. More specifically, as shown in FIG. 10, face 71 bears a "+" sign 75 representing the mathematical operation of addition, face 72 bears a sign 76 representing the mathematical operation of subtraction, face 73 bears a "·" sign 77 representing the mathematical operation of multiplication, and face 70 bears the word "otazoi" 74 representing a mathematical operation of choice.

Set of Hexahedron Dice

As to FIGS. 12 and 13, a hexahedron first numerical die 900 of FIG. 12 is substantially identical to a hexahedron second numerical die 1,000 of FIG. 13. Each of the hexahedron first and second numerical dice 900 and 1,000, respectively, has six faces, including faces 80 through 82 as show in FIG. 12 and faces 90 through 92 as shown in FIG. 13. Each of faces 80 through 83 and 90 through 92 of the hexahedron first and second numerical dice 900 and 1,000, respectively, is substantially square, has substantially the same surface area, and bears a different indicia of numerical value (e.g., the Arabic numerals 0, 3, and 4 as shown in FIG. 12 as respective items 83 through 85 and the Arabic numerals 1, 2, and 5 as shown in FIG. 13 as respective items 93 through 95). In addition, each of faces 80 through 82 and 90 through 92 of hexahedron first and second numerical dice 900 and 1,000, respectively, has an opposing face that lies in a substantially parallel plane. (In other words, each of the hexahedron first and second numerical dice 900 and 1,000, respectively, has 3 pairs of opposing faces that lie in substantially parallel planes.)

A hexahedron first operator die 1,100 shown in FIG. 14 is identical in shape to the hexahedron first and second numerical dice 900 and 1,000 illustrated in FIGS. 12, and 13, respectively. However, each of the six faces (including faces 100 through 102 shown in FIG. 14) of the hexahedron first operator die bears an indicia representing a mathematical operation (such as addition, subtraction, or a mathematical operation to be chosen by a player) as opposed to the indicia of numerical value born by the faces 80 through 82 and 90 through 92 of the hexahedron first and second numerical dice 900 and 1,000, respectively. More specifically, as shown in FIG. 14, face 102 bears a "+" sign 105 representing the mathematical operation of addition, face 101 bears a "−" sign 104 representing the mathematical operation of subtraction, and face 100 bears the word "otazoi" 103 representing a mathematical operation of choice.

Figure 15:
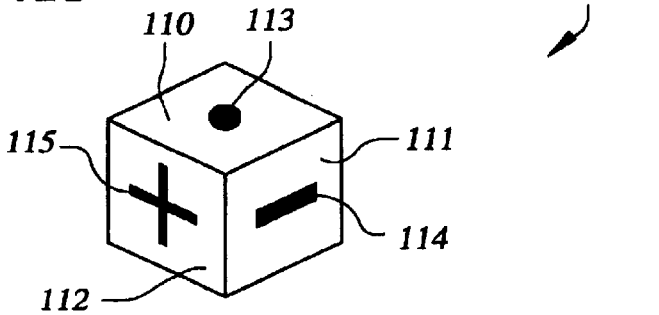
FIG. 15 is a top view of a hexahedron second operator die, where each of the six faces of the die has substantially the same surface area.

FIG. 15 illustrates a hexahedron second operator die 1,200 that is also identical in shape to the hexahedron first and second numerical dice 900 and 1,000 illustrated in FIGS. 12 and 13, respectively. However, similar to the first operator die 1,100 of FIG. 14, each of the six faces (including faces 110 through 112 shown in FIG. 15) of the hexahedron second operator die 1,200 bears an indicia representing a mathematical operation (such as addition, subtraction, multiplication, or a mathematical operation to be chosen by a player) as opposed to the indicia of numerical value born by the faces 80 through 82 and 90 through 92 of the hexahedron first and second numerical dice 900 and 1,000, respectively. More specifically, as shown in FIG. 15, face 112 bears a "+" sign 115 representing the mathematical operation of addition, face 111 bears a "−" sign 114 representing the mathematical operation of subtraction, and face 110 bears a "·" sign 113 representing the mathematical operation of multiplication.

Set of Dodecahedron Dice

Concerning FIGS. 16 and 17, a dodecahedron first numerical die 1,300 of FIG. 16 is substantially identical to a dodecahedron second numerical die 1,400 of FIG. 17. Each of the dodecahedron first and second numerical dice 1,300 and 1,400, respectively, has twelve faces, including faces 120 through 125 as show in FIG. 16 and faces 140 through 145 as shown in FIG. 17. Each of faces 120 through 125 and 140 through 145 of the dodecahedron first and second numerical dice 1,300 and 1,400, respectively, is substantially pentagonal, has substantially the same surface area, and bears a different indicia of numerical value (e.g., the Arabic numerals 1, 4, 5, 8, 9, and 12 as shown in FIG. 16 as respective items 126 through 131 and the Arabic numerals 2, 3, 6, 7, 10, and 11 as shown in FIG. 17 as respective items 146 through 151). In addition, each of faces 120 through 125 and 140 through 145 of dodecahedron first and second numerical dice 1,300 and 1,400, respectively, has an opposing face that lies in a substantially parallel plane. (In other words, each of the dodecahedron first and second numerical dice 1,300 and 1,400, respectively, has 6 pairs of opposing faces that lie in substantially parallel planes.)

A dodecahedron first operator die 1,500 shown in FIG. 18 is identical in shape to the dodecahedron first and second numerical dice 1,300 and 1,400 illustrated in FIGS. 16 and 17, respectively. However, each of the twelve faces (including faces 160 through 165 shown in FIG. 18) of the dodecahedron first operator die bears an indicia representing a mathematical operation (such as addition, subtraction, or a mathematical operation to be chosen by a player) as opposed to the indicia of numerical value born by the faces 120 through 125 and 140 through 145 of the dodecahedron first and second numerical dice 1,300 and 1,400, respectively. More specifically, as shown in FIG. 18, faces 160, 161, and 164 bear "+" signs 166, 171, and 169, respectively, representing the mathematical operation of addition, faces 162 and 165 bear "−" signs 167 and 170, respectively, representing the mathematical operation of subtraction, and face 163 bears the word "otazoi" 168 representing a mathematical operation of choice.

Figure 19:
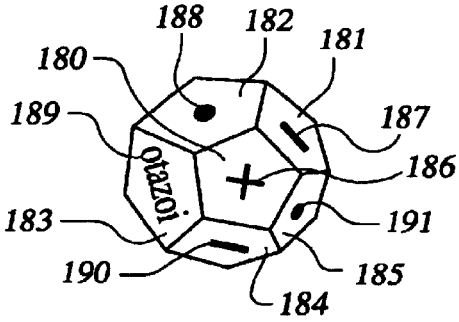
FIG. 19 is a top perspective view of a dodecahedron second operator die, where each of the twelve faces of the die is substantially pentagonal and has substantially the same surface area It should be noted that the same numbers in the figures represent the same element of the dice game apparatus of the present invention.

FIG. 19 illustrates a dodecahedron second operator die 1,600 that is also identical in shape to the dodecahedron first and second numerical dice 1,300 and 1,400 illustrated in FIGS. 16 and 17, respectively. However, similar to the first operator die 1,500 of FIG. 18, each of the twelve faces (including faces 180 through 185 shown in FIG. 19) of the dodecahedron second operator die bears 1,600 an indicia representing a mathematical operation (such as addition, subtraction, multiplication, or a mathematical operation to be chosen by a player) as opposed to the indicia of numerical value born by the faces 120 through 125 and 140 through 145 of the dodecahedron first and second numerical dice 1,300 and 1,400, respectively. More specifically, as shown in FIG. 19, face 180 bears a "+" sign 186 representing the mathematical operation of addition, faces 181 and 184 bear "−" signs 187 and 190, respectively, representing the mathematical operation of subtraction, faces 182 and 185 bear "·" signs 188 and 191, respectively, representing the mathematical operation of multiplication, and face 183 bears the word "otazoi" 189 representing a mathematical operation of choice.

The dice games of the present invention are played by one or more players who take turns rolling or three dice, namely, two numerical dice and one operator die. Generally, the three dice are rolled substantially simultaneously. The player who rolled the dice gives the answer to the mathematical problem posed by the two numerals on the uppermost faces of the two numerical dice operated upon by the mathematical function shown on the uppermost face of the single operator die. If the player gives the correct answer, the player is awarded a predetermined number of points (e.g., 1 point for a correct answer to an addition problem, 2 points for a correct answer to a subtraction problem, 3 points for a correct answer to a multiplication problem, and 4 points for a correct answer to a division problem) and play advances to the next player. If the player gives the wrong answer, play advances to the next player who must then give an answer to the mathematical problem posed by the dice rolled by the previous player. If the subsequent player gives the right answer, he is awarded the predetermined amount of points and is allowed to roll the dice and answer the new problem posed by the rolled dice before play again advances to the next player. However, if the subsequent player also gives the wrong answer, play again advances to the next player as described above. The following Table IV sets forth exemplary numerals and mathematical operations posed by rolling the dodecahedron first and second numerical dice 1,300 and 1,400 of FIGS. 16 and 17, respectively, and the dodecahedron second operator die 1,600 of FIG. 19.

TABLE IV

Exemplary Dice Game of Present Invention

| Uppermost Number on Dodecahedron First Numerical Die 1,300 | Uppermost Number on Dodecahedron Second Numerical Die 1,400 | Uppermost Symbol on Dodecahedron Second Operator Die 1,600 | Correct Answer |
|---|---|---|---|
| 12 | 3 | + | 15 |
| 5 | 11 | −[a] | 6 |
| 9 | 2 | −[a] | 7 |
| 4 | 10 | • | 40 |
| 2 | 8 | otazoi[b] - division | 4 |
| 5 | 12 | otazoi[c] - multiplication | 60 |

[a]Unless a player is familiar with negative numbers, when the mathematical operation is subtraction, the smaller number is always subtracted from the larger number.

[b]The word "otazoi" as used on the operator die denotes a mathematical operation of choice selected from the group consisting of addition, subtraction, multiplication, and division, the mathematical operation to be chosen by the player whose turn it is. In this case, the player chose the mathematical operation to be division. Unless the player is familiar with decimals, division should only be chosen when the smaller number is divisible into the larger number to yield a whole number.

[c]The word "otazoi" as used on the operator die denotes a mathematical operation of choice selected from the group consisting of addition, subtraction, multiplication, and division, the mathematical operation to be chosen by the player whose turn it is. In this case, the player chose the mathematical operation to be multiplication.

While the preferred embodiments of the invention have been set forth above in detail, some modifications can be made to the preferred version without departing from the spirit of the present invention. For example, instead of using dice having the same number of faces to play a game of dice, dice with dissimilar number of faces can be used. Likewise, instead of the octahedron and decahedron dice having round faces as shown in FIGS. 7 through 10 and 1 through 4, respectively, the octahedron and decahedron dice can have triangular faces such as 200 though 203 and 210 through 214 shown in respective FIGS. 20 and 21. (Nevertheless, roundfaced octahedron and decahedron dice are preferred because they tend to roll more like a ball.) Accordingly, the foregoing alternative embodiments are included within the scope of the present invention.

What is claimed is:

1. A dice game apparatus comprising a first $N_1$-faced numerical die, a second $N_1$-faced numerical die, and a first $N_3$-faced operator die, where (a) $N_1$ is an even whole number selected from the group consisting of 8 and 10;

(b) each of the $N_1$ faces of the first numerical die is substantially circular;

(c) each of the $N_1$ faces of the first numerical die has substantially the same surface area;

(d) the $N_1$-faced first numerical die has $N_1/2$ pairs of opposing faces, with each of the $N_1/2$ pairs of opposing faces of the first numerical die lying in a pair of substantially parallel planes;

(e) each face of the first numerical die bears a different first indicia of numerical value from 0 to $N_1$, provided that if 0 appears on any face of the first numerical die, the highest indicia of numerical value on any face of the first numerical die is $N_1-1$;

(f) N2 is an even whole number selected from the group consisting of 8 and 10;

(g) each of the $N_2$ faces of the second numerical die is substantially circular;

(h) each of the $N_2$ faces of the second numerical die has substantially the same surface area;

(i) the $N_2$-faced second numerical die has $N_2/2$ pairs of opposing faces, with each of the $N_2/2$ pairs of opposing faces of the second numerical die lying in a pair of substantially parallel planes;

(j) each face of the second numerical die bears a different second indicia of numerical value from 0 to $N_2$, provided that if 0 appears on any face of the second numerical die, the highest indicia of numerical value on any face of the second numerical die is $N_2-1$;

(k) $N_3$ is an even whole number selected from the group consisting of 8 and 10;

(l) each of the $N_3$ faces of the first operator die is substantially circular;

(m) each of the $N_3$ faces of the first operator die has substantially the same surface area;

(n) the $N_3$-faced first operator die has $N_3/2$ pairs of opposing faces, with each of the $N_3/2$ pairs of opposing faces of the first operator die lying in a pair of substantially parallel planes;

(o) $X_1$ faces of the first operator die bear a third indicia representing the mathematical operation of addition, with $X_1$ being a whole number from 1 to $2/3N_3$;

(p) $Y_1$ faces of the first operator die bear a fourth indicia representing the mathematical operation of subtraction, with $Y_1$ being a whole number from 1 to $2/3N_3$;

(q) $Z_1$ faces of the first operator die bear a fifth indicia representing a mathematical operation to be chosen by a player, the mathematical operation being selected from the group consisting of addition, subtraction, multiplication, and division, with $Z_1$ being a whole number from 0 to $N_3/3$; and (r) $X_1+Y_1+Z_1=N_3$.

2. A dice game apparatus comprising a first $N_1$-faced numerical die, a second $N_2$-faced numerical die, and a second $N_4$-faced operator die, where (a) $N_1$ is an even whole number selected from the group consisting of 8 and 10;

(b) each of the $N_1$ faces of the first numerical die is substantially circular;

(c) each of the $N_1$ faces of the first numerical die has substantially the same surface area;

(d) the $N_1$-faced first numerical die has $N_1/2$ pairs of opposing faces, with each of the $N_1/2$ pairs of opposing faces of the first numerical die lying in a pair of substantially parallel planes;

(e) each face of the first numerical die bears a different first indicia of numerical value from 0 to $N_1$, provided that if 0 appears on any face of the first numerical die, the highest indicia of numerical value on any face of the first numerical die is $N_1-1$;

(f) $N_2$ is an even whole number selected from the group consisting of 8 and 10;

(g) each of the $N_2$ faces of the second numerical die is substantially circular;

(h) each of the $N_2$ faces of the second numerical die has substantially the same surface area;

(i) the $N_2$-faced second numerical die has $N_2/2$ pairs of opposing faces, with each of the $N_2/2$ pairs of opposing faces of the second numerical die lying in a pairs of substantially parallel planes;

(j) each face of the second numerical die bears a different second indicia of numerical value from 0 to $N_2$, provided that if 0 arrears on any face of the second numerical die, the highest indicia of numerical value on any face of the second numerical die is $N_2-1$;

(k) $N_4$ is an even whole number selected from the group consisting of 8 and 10;

(l) each of the $N_4$ faces of the second operator die is substantially circular;

(m) each of the $N_4$ faces of the second operator die has substantially the same surface area;

(n) the $N_4$-faced second operator die has $N_4/2$ pairs of opposing faces, with each of the $N_4/2$ pairs of opposing faces of the second operator die lying in a pair of substantially parallel planes;

(o) $X_2$ faces of the second operator die bear a sixth indicia representing the mathematical operation of addition, with $X_2$ being a whole number from 1 to $N_4/2$;

(p) $Y_2$ faces of the second operator die bear a seventh indicia representing the mathematical operation of subtraction, with $Y_2$ being a whole number from 1 to $N_4/2$;

(q) $Z_2$ faces of the second operator die bear an eighth indicia representing the mathematical operation of multiplication, with $Z_2$ being a whole number from 1 to $N_4/2$;

(r) $A_2$ faces of the first operator die bear a ninth indicia representing a mathematical operation to be chosen by a player, the mathematical operation being selected from the group consisting of addition, subtraction, multiplication, and division, with $A_2$ being a whole number from 0 to $N_4/4$; and (S) $X_2+Y_2+Z_2+A_2=N_4$.

3. A dice game apparatus comprising a first $N_1$-faced numerical die, a second $N_2$-faced numerical die, a first $N_3$-faced operator die, and a second $N_4$-faced operator die, where (a) $N_1$ is an even whole number selected from the group consisting of 8 and 10;

(b) each of the $N_1$ faces of the first numerical die is substantially circular;

(c) each of the $N_1$ faces of the first numerical die has substantially he same surface area;

(d) the $N_1$-faced first numerical die has $N_1/2$ pairs of opposing faces, with each of the $N_1/2$ pairs of opposing faces of the first numerical die lying in a pair of substantially parallel planes;

(e) each face of the first numerical die bears a different first indicia of numerical value from 0 to $N_1$, provided that if 0 appears on any face of the first numerical die, the highest indicia of numerical value on any face of the first numerical die is $N_1-1$;

(f) $N_2$ is an even whole number selected from the group consisting of 8 and 10;

(g) each of the $N_2$ faces of the second numerical die is substantially circular;

(h) each of the $N_2$ faces of the second numerical die has substantially the same surface area;

(i) the $N_2$-faced second numerical die has $N_2/2$ pairs of opposing faces, with each of the $N_2/2$ pairs of opposing faces of the second numerical die lying in a pair of substantially parallel planes;

(j) each face of the second numerical die bears a different second indicia of numerical value from 0 to $N_2$, provided that if 0 appears on any face of the second numerical die, the highest indicia of numerical value on any face of the second numerical die is $N_2-1$;

(k) $N_3$ and $N_4$ are each an even whole number selected from the group consisting of 8 and 10;

(l) each of the $N_3$ faces of the first operator die and each of the $N_4$ faces of the second operator die is substantially circular;

(m) each of the $N_3$ faces of the first operator die and each of the $N_4$ faces of the second operator die has substantially the same surface area;

(n) the $N_3$-faced first operator die has $N_3/2$ pairs of opposing faces, with each of the $N_3/2$ pairs of opposing faces of the first operator die lying in a pair of substantially parallel planes;

(o) $X_1$ faces of the first operator die bear a third indicia representing the mathematical operation of addition, with $X_1$ being a whole number from 1 to $2/3N_3$;

(p) $Y_1$ faces of the first operator die bear a fourth indicia representing the mathematical operation of subtraction, with $Y_1$ being a whole number from 1 to $2/3N_3$;

(q) $Z_1$ faces of the first operator die bear a fifth indicia representing a mathematical operation to be chosen by a player, the mathematical operation being selected from the group consisting of addition, subtraction, multiplication, and division, with $Z_1$ being a whole number from 0 to $N_3/3$;

(r) $X_1+Y_1+Z_1=N_3$;

(s) the $N_4$-faced second operator die has $N_4/2$ pairs of opposing faces, with each of the $N_4/2$ pairs of opposing faces of the second operator die lying in a pair of substantially parallel planes;

(t) $X_2$ faces of the second operator die bear a sixth indicia representing the mathematical operation of addition, with $X_2$ being a whole number from 1 to $N_4/2$;

(u) $Y_2$ faces of the second operator die bear a seventh indicia representing the mathematical operation of subtraction, with $Y_2$ being a whole number from 1 to $N_4/2$;

(v) $Z_2$ faces of the second operator die bear an eighth indicia representing the mathematical operation of multiplication, with $Z_2$ being a whole number from 1 to $N_4/2$;

(w) $A_2$ faces of the second operator die bear a ninth indicia representing a mathematical operation to be chosen by a player, the mathematical operation being selected from the group consisting of addition, subtraction, multiplication, and division, with $A_2$ being a whole number from 0 to $N_4/4$; and (x) $X_2+Y_2+Z_2+A_2=N_4$.

4. The dice game apparatus of claim 3 where each of the $N_1$ faces of the first numerical die, each of the $N_2$ faces of the second numerical die, each of the $N_3$ faces of the first operator die, and each of the $N_4$ faces of the second operator die has substantially the same surface area.

5. The dice game apparatus of claim 4 where $N_1=N_2=N_3=N_4=8$.

6. The dice game apparatus of claim 4 where $N_1=N_2=N_3=N_4=10$.

7. A dice game apparatus comprising at least one set consisting essentially of:

(a) a first numerical die;

(b) a second numerical die; and (c) at least one operator die selected from the group consisting of a first operator die and a second operator die, where (i) the first numerical die has at least $N_1$ faces, with $N_1$ being a whole, even number from 6 to 20;

(ii) the $N_1$-faced first numerical die has $N_1/2$ pairs of opposing faces, with each of the $N_1/2$ pairs of opposing faces of the first numerical die lying in a pair of substantially parallel planes;

(iii) each face of the first numerical die bears a different first indicia of numerical value from 0 to $N_1$, provided that if 0 appears on any face of the first numerical die, the highest first indicia of numerical value on any face of the first numerical die is $N_1-1$;

(iv) the second numerical die has at least $N_2$ faces, with $N_2$ being a whole, even number from 6 to 20;

(v) the $N_2$-faced second numerical die has $N_2/2$ pairs of opposing faces, with each of the $N_2/2$ pairs of opposing faces of the second numerical die lying in a pair of substantially parallel planes;

(vi) each face of the second numerical die bears a different second indicia of numerical value from 0 to $N_2$, provided that if 0 appears on any face of the second numerical die, the highest second indicia of numerical value on any face of the second numerical die is $N_2-1$;

(vii) the first operator die has at least $N_3$ faces, with $N_3$ being a whole, even number from 6 to 20;

(viii) the $N_3$-faced first operator die has $N_3/2$ pairs of opposing faces, with each of the $N_3/2$ pairs of opposing faces of the first operator die lying in a pair of substantially parallel planes;

(ix) the first operator die bears a third indicia representing the mathematical operation of addition on $X_1$ of the faces of the first operator die, where $X_1$ is a whole number from 1 to $2/3N_3$;

(x) the first operator die bears a fourth indicia representing the mathematical operation of subtraction on $Y_1$ of the faces of the first operator die, where $Y_1$ is a whole number from 1 to $2/3N_3$;

(xi) the first operator bears a fifth indicia representing a mathematical operation to be chosen by a player, the mathematical operation being selected from the group consisting of addition, subtraction, multiplication, and division on $Z_1$ of the faces of the first operator die, where $Z_1$ is a whole number from 0 to $1/3N_3$;

(xii) $X_1+Y_1+Z_1=N_3$;

(xiii) the second operator die has at least $N_4$ faces, with $N_4$ being a whole, even number from 6 to 20;

(xiv) the $N_4$-faced second operator die has $N_4/2$ pairs of opposing faces, with each of the $N_4/2$ pairs of opposing faces of the second operator die lying in a pair of substantially parallel planes;

(xv) the second operator die bears sixth indicia representing the mathematical operation of addition on $X_2$ of the faces of the second operator die, where $X_2$ is a whole number from 1 to $1/2N_4$;

(xvi) the second operator die bears a seventh indicia representing the mathematical operation of subtraction on $Y_2$ of the faces of the second operator die, where $Y_2$ is a whole number from 1 to $1/2N_4$;

(xvii) the second operator die bears an eighth indicia representing the mathematical operation of multiplication on $Z_2$ of the faces of the second operator die, where $Z_2$ is a whole number from 1 to $1/2N_4$;

(xviii) the second operator bears a ninth indicia representing a mathematical operation to be chosen by a player, the mathematical operation being selected from the group consisting of addition, subtraction, multiplication, and division on $A_2$ of the faces of the second operator die, where $A_2$ is a whole number from 0 to $1/4N_4$;

(xix) $X_2+Y_2+Z_2+A_2=N_4$.

8. The dice game apparatus of claim 7 where each of the faces of the first numerical die has substantially the same surface area;

each of the faces of the second numerical die has substantially the same surface area;

each of the faces of the first operator die has substantially the same surface area;

each of the faces of the second operator die has substantially the same surface area.

9. The dice game apparatus of claim 7 comprising the first operator die and the second operator die.

10. The dice game apparatus of claim 7 where $N_1=N_2=N_3=N_4$.

11. The dice game apparatus of claim 10 where each of the faces of the first numerical die, each of the faces of the second numerical die, each of the faces of the first operator die, and each of the faces of the second operator die has substantially the same surface area.

12. The dice game apparatus of claim 7 comprising the first operator die and the second operator die, where $N_1=N_2=N_3=N_4$.

13. The dice game apparatus of claim 7 where the first numerical die is a dodecahedron;

each face of the first numerical die bears a different first indicia of numerical value from 0 to 12, provided that if 0 appears on any face of the first numerical die, the highest first indicia of numerical value on any face of the first numerical die is 11;

the second numerical die is a dodecahedron;

each face of the second numerical die bears a different second indicia of numerical value from 0 to 12, provided that if 0 appears on any face of the second numerical die, the highest second indicia of numerical value on any face of the second numerical die is 11;

the first operator die is a dodecahedron;

the first operator die bears a third indicia representing the mathematical operation of addition on $X_1$ of the faces of the first operator die, where $X_1$ is a whole number from 1 to 8;

the first operator die bears a fourth indicia representing the mathematical operation of subtraction on $Y_1$ of the faces of the first operator die, where $Y_1$ is a whole number from 1 to 8;

the first operator bears a fifth indicia representing a mathematical operation to be chosen by a player, the mathematical operation being selected from the group consisting of addition, subtraction, multiplication, and division on $Z_1$ of the faces of the first operator die, where $Z_1$ is a whole number from 0 to 4;

$X_1+Y_1+Z_1=12$;

the second operator die is a dodecahedron;

the second operator die bears a sixth indicia representing the mathematical operation of addition on $X_2$ of the faces of the second operator die, where $X_2$ is a whole number from 1 to 6;

the second operator die bears a seventh indicia representing the mathematical operation of subtraction on $Y_2$ of the faces of the second operator die, where $Y_2$ is a whole number from 1 to 6; the second operator die bears an eighth indicia representing the mathematical operation of multiplication on $Z_2$ of the faces of the second operator die, where $Z_2$ is a whole number from 1 to 6;

the second operator bears a ninth indicia representing a mathematical operation to be chosen by a player, the mathematical operation being selected from the group consisting of addition, subtraction, multiplication, and division on $A_2$ of the faces of the second operator die, where $A_2$ is a whole number from 0 to 4;

$X_2+Y_2+Z_2+A_2=12$.

14. The dice game apparatus of claim 7 where the first numerical die is a hexahedron;

each face of the first numerical die bears a different first indicia of numerical value from 0 to 6, provided that if 0 appears on any face of the first numerical die, the highest indicia of numerical value of any face of the first numerical die is 5;

the second numerical die is a hexahedron;

each face of the second numerical die bears a different second indicia of numerical value from 0 to 6, provided that if 0 appears on any face of the second numerical die, the highest indicia of numerical value of any face of the second numerical die is 5;

the first operator die is a hexahedron;

the first operator die bears a third indicia representing the mathematical operation of addition on $X_1$ of the faces of the first operator die, where $X_1$ is a whole number from 1 to 4;

the first operator die bears a fourth indicia representing the mathematical operation of subtraction on $Y_1$ of the faces of the first operator die, where $Y_1$ is a whole number from 1 to 4;

the first operator bears a fifth indicia representing a mathematical operation to be chosen by a player, the mathematical operation being selected from the group consisting of addition, subtraction, multiplication, and division on $Z_1$ of the faces of the first operator die, where $Z_1$ is a whole number from 0 to 2;

$X_1+Y_1+Z_1=6$;

the second operator die is a hexahedron;

the second operator die bears a sixth indicia representing the mathematical operation of addition on $X_2$ of the faces of the second operator die, where $X_2$ is a whole number from 1 to 3;

the second operator die bears a seventh indicia representing the mathematical operation of subtraction on $Y_2$ of the faces of the second operator die, where $Y_2$ is a whole number from 1 to 3;

the second operator die bears an eighth indicia representing the mathematical operation of multiplication on $Z_2$ of the faces of the second operator die, where $Z_2$ is a whole number from 1 to 3;

the second operator bears a ninth indicia representing a mathematical operation to be chosen by a player, the mathematical operation being selected from the group consisting of addition, subtraction, multiplication, and division on $A_2$ of the faces of the second operator die, where $A_2$ is a whole number from 0 to 1;

$X_2+Y_2+Z_2+A_2=6$.

15. A method for playing dice comprising the steps of:

(a) rolling a first numerical die;

(b) rolling a second numerical die;

(c) rolling an operator die; and (d) solving the mathematical problem posed by the uppermost indicia on the first numerical die, the second numerical die, and the operator die, where (i) the operator die is selected from the group consisting of a first operator die and a second operator die, (ii) the first numerical die has at least $N_1$ faces, with $N_1$ being a whole, even number from 6 to 20;

(iii) the $N_1$-faced first numerical die has $N_1/2$ pairs of opposing faces, with each of the $N_1/2$ pairs of opposing faces of the first numerical die lying in a pair of substantially parallel planes;

(iv) each face of the first numerical die bears a different first indicia of numerical value from 0 to $N_1$, provided that if 0 appears on any face of the first numerical die, the highest first indicia of numerical value on any face of the first numerical die is $N_1-1$;

(v) the second numerical die has at least $N_2$ faces, with $N_2$ being a whole, even number from 6 to 20;

(vi) the $N_2$-faced second numerical die has $N_2/2$ pairs of opposing faces, with each of the $N_2/2$ pairs of opposing faces of the second numerical die lying in a pair of substantially parallel planes;

(vii) each face of the second numerical die bears a different second indicia of numerical value from 0 to $N_2$, provided that if 0 appears on any face of the second numerical die, the highest second indicia of numerical value on any face of the second numerical die is $N_2-1$;

(viii) the first operator die has at least $N_3$ faces, with $N_3$ being a whole, even number from 6 to 20;

(ix) the $N_3$-faced first operator die has $N_3/2$ pairs of opposing faces, with each of the $N_3/2$ pairs of opposing faces of the first operator die lying in a pair of substantially parallel planes;

(x) the first operator die bears a third indicia representing the mathematical operation of addition on $X_1$ of the faces of the first operator die, where $X_1$ is a whole number from 1 to $2/3N_3$;

(xi) the first operator die bears a fourth indicia representing the mathematical operation of subtraction on $Y_1$ of the faces of the first operator die, where $Y_1$ is a whole number from 1 to $2/3N_3$;

(xii) the first operator bears a fifth indicia representing a mathematical operation to be chosen by a player, the mathematical operation being selected from the group consisting of addition, subtraction, multiplication, and division on $Z_1$ of the faces of the first operator die, where $Z_1$ is a whole number from 0 to $1/3N_3$;

(xiii) $X_1+Y_1+Z_1=N_3$;

(xiv) the second operator die has at least $N_4$ faces, with $N_4$ being a whole, even number from 6 to 20;

(xv) the $N_4$-faced second operator die has $N_4/2$ pairs of opposing faces, with each of the $N_4/2$ pairs of opposing faces of the second operator die lying in a pair of substantially parallel planes;

(xvi) the second operator die bears sixth indicia representing the mathematical operation of addition on $X_2$ of the faces of the second operator die, where $X_2$ is a whole number from 1 to $1/2N_4$;

(xvii) the second operator die bears a seventh indicia representing the mathematical operation of subtraction on $Y_2$ of the faces of the second operator die, where $Y_2$ is a whole number from 1 to $1/2N_4$;

(xviii) the second operator die bears an eighth indicia representing the mathematical operation of multiplication on $Z_2$ of the faces of the second operator die, where $Z_2$ is a whole number from 1 to $1/2N_4$;

(xix) the second operator bears a ninth indicia representing a mathematical operation to be chosen by a player, the mathematical operation being selected from the group consisting of addition, subtraction, multiplication, and division on $A_2$ of the faces of the second operator die, where $A_2$ is a whole number from 0 to $1/4N_4$; and (xx) $X_2+Y_2+Z_2+A_2=N_4$.

16. The method of claim 15 where steps (a) through (c) are performed substantially simultaneously.

17. The method of claim 15 where steps (a) through (d) are performed a plurality of times.

18. The method of claim 15 where steps (a) through (c) are performed substantially simultaneously and steps (a) through (d) are performed a plurality of times.

* * * * *